US007497763B2

(12) United States Patent
Bottema et al.

(10) Patent No.: US 7,497,763 B2
(45) Date of Patent: Mar. 3, 2009

(54) POLISHING PAD, A POLISHING APPARATUS, AND A PROCESS FOR USING THE POLISHING PAD

(75) Inventors: Brian E. Bottema, Austin, TX (US); Stephen F. Abraham, Austin, TX (US); Alex P. Pamatat, Grenoble (FR)

(73) Assignee: Freescale Semiconductor, Inc., Austin, TX (US)

( * ) Notice: Subject to any disclaimer, the term of this patent is extended or adjusted under 35 U.S.C. 154(b) by 159 days.

(21) Appl. No.: 11/390,176

(22) Filed: Mar. 27, 2006

(65) Prior Publication Data

US 2007/0224917 A1 Sep. 27, 2007

(51) Int. Cl.
*B24B 49/00* (2006.01)

(52) U.S. Cl. ..... 451/6; 451/10; 451/11; 451/41

(58) Field of Classification Search ..... 451/6, 451/9, 10, 11, 41, 287, 526, 530
See application file for complete search history.

(56) References Cited

U.S. PATENT DOCUMENTS

| | | | | |
|---|---|---|---|---|
| 5,334,482 | A | 8/1994 | Aono | |
| 5,433,651 | A | 7/1995 | Lustig et al. | |
| 5,461,007 | A | 10/1995 | Kobayashi | |
| 5,691,253 | A | 11/1997 | Kobayashi | |
| 6,146,248 | A | 11/2000 | Jairath et al. | |
| 6,254,459 | B1 | 7/2001 | Bajaj et al. | |
| 6,280,289 | B1 | 8/2001 | Wisswesser et al. | |
| 6,280,290 | B1 | 8/2001 | Birang et al. | |
| 6,323,046 | B1 | 11/2001 | Agarwal | |
| 6,454,630 | B1 | 9/2002 | Tolles | |
| 6,599,765 | B1 | 7/2003 | Boyd et al. | |
| 6,688,945 | B2 | 2/2004 | Liu | |
| 6,709,493 | B2 | 3/2004 | DeGuiseppi et al. | |
| 6,722,949 | B2 | 4/2004 | Hu et al. | |
| 6,866,559 | B2 * | 3/2005 | Lehman et al. | 451/8 |
| 6,875,077 | B2 | 4/2005 | Petroski et al. | |

(Continued)

FOREIGN PATENT DOCUMENTS

| | | | |
|---|---|---|---|
| WO | 2007/030348 | A3 | 3/2007 |

OTHER PUBLICATIONS

U.S. Appl. No. 11/221,376, filed Sep. 6, 2005, entitled "Platen Endpoint Window with Pressure Relief," by Bottema.

(Continued)

*Primary Examiner*—Eileen P. Morgan

(57) ABSTRACT

A polishing pad can include a first layer and a second layer. The first layer can have a first polishing surface and a first opening. The second layer can have an attaching surface and a second opening substantially contiguous with the first opening. The polishing pad can further include, a pad window lying within the first opening. The pad window can include a second polishing surface. When the pad would be attached to a platen, the first and second polishing surfaces can lie along a same plane, and an opposing surface of the pad window can abut an exterior surface of a platen window. In another aspect, a polishing apparatus can include an exterior surface of a platen window abutting the polishing pad. In still another aspect, a process of polishing can include polishing a workpiece such that the pad window contacts the workpiece and the platen window simultaneously.

20 Claims, 2 Drawing Sheets

U.S. PATENT DOCUMENTS

| | | | | |
|---|---|---|---|---|
| 6,887,138 | B2 | 5/2005 | Bottema et al. | |
| 6,905,392 | B2 | 6/2005 | Bottema et al. | |
| 6,953,515 | B2 | 10/2005 | Boyd et al. | |
| 7,179,151 | B1 | 2/2007 | Bottema et al. | |
| 7,210,980 | B2 | 5/2007 | Swedek et al. | |
| 7,226,339 | B2 | 6/2007 | Benvegnu et al. | |
| 7,261,625 | B2 * | 8/2007 | Hishiki | 451/526 |
| 2003/0109209 | A1 * | 6/2003 | Hishiki | 451/527 |
| 2004/0053566 | A1 | 3/2004 | Tolles et al. | |
| 2006/0063471 | A1 * | 3/2006 | Muldowney | 451/6 |
| 2007/0021037 | A1 * | 1/2007 | Birang et al. | 451/6 |
| 2007/0212980 | A1 * | 9/2007 | Lim et al. | 451/6 |

OTHER PUBLICATIONS

U.S. Appl. No. 11/221,376, Office Action mailed Nov. 30, 2007.
U.S. Appl. No. 11/221,376, Office Action mailed Jul. 11, 2008.

* cited by examiner

-PRIOR ART-

30

40

POLISHING PAD, A POLISHING APPARATUS, AND A PROCESS FOR USING THE POLISHING PAD

RELATED APPLICATION

The present disclosure relates to U.S. patent application Ser. No. 11/390,292, entitled "Polishing Pad, a Polishing Apparatus, and a Process For Using the Polishing Pad" by Bottema et. al. filed on Mar. 27, 2006, which is assigned to the current assignee hereof and incorporated by reference in its entirety.

BACKGROUND

1. Field of the Disclosure

The present disclosure relates to polishing pads, polishing apparatuses, and processes for using polishing pads, and, more particularly, to polishing pads that have pad windows, polishing apparatuses that include such polishing pads, and processes for using them.

2. Description of the Related Art

A pad window within a polishing pad can serve as a portion of a path for laser light for measuring a wafer during a polishing process. The pad window can cause problems due to its configuration within a chemical mechanical polishing apparatus. FIG. 1 includes an illustration of a cross-sectional view of a chemical mechanical polishing ("CMP") apparatus 10 and a wafer 128. The CMP apparatus 10 can include a platen 12 and a conventional polishing pad 14. The platen 12 can include a platen window 16. The CMP apparatus 10 also includes a laser 18 and a detector 110 that can be used for end point detection. The conventional polishing pad 14 includes a first layer 112 that has an opening 114 and a substantially planar polishing surface 116. A pad window 122 lies within the opening 114 in the first layer 112. The pad window 122 has a polishing surface 126. The conventional polishing pad 14 can have a second layer 118, lying between the first layer 112 and the platen 12. Since the second layer 118 is substantially opaque to a radiation beam from the laser 18, an opening 120 in the second layer is formed such that there is a path for the radiation beam to pass from the laser 18 to the wafer surface and back to the detector 110.

The path is intermittently formed such that a measurement, using the laser 18 and the detector 110, can be taken when the pad window 122 lies between the platen 12 and the wafer 128. However, changes in temperature during polishing can distort the polishing surface 126 of the pad window 122. Distortion can cause problems with a polishing process. Examples of such problems can be a false or absent reading of endpoint detection, part or all of the pad window 122 becoming separated from the rest of the conventional polishing pad 14, excessive wear or a breach of the pad window 122, or any combination thereof. The interaction of distorted polishing surface 126 and a wafer 128 during a polishing process can also damage the wafer 128, the CMP apparatus 10, or any combination thereof.

BRIEF DESCRIPTION OF THE DRAWINGS

The present disclosure may be better understood, and its numerous features and advantages made apparent to those skilled in the art by referencing the accompanying drawings. The subject of the disclosure is illustrated by way of example and not limitation in the accompanying figures.

Figure 1:
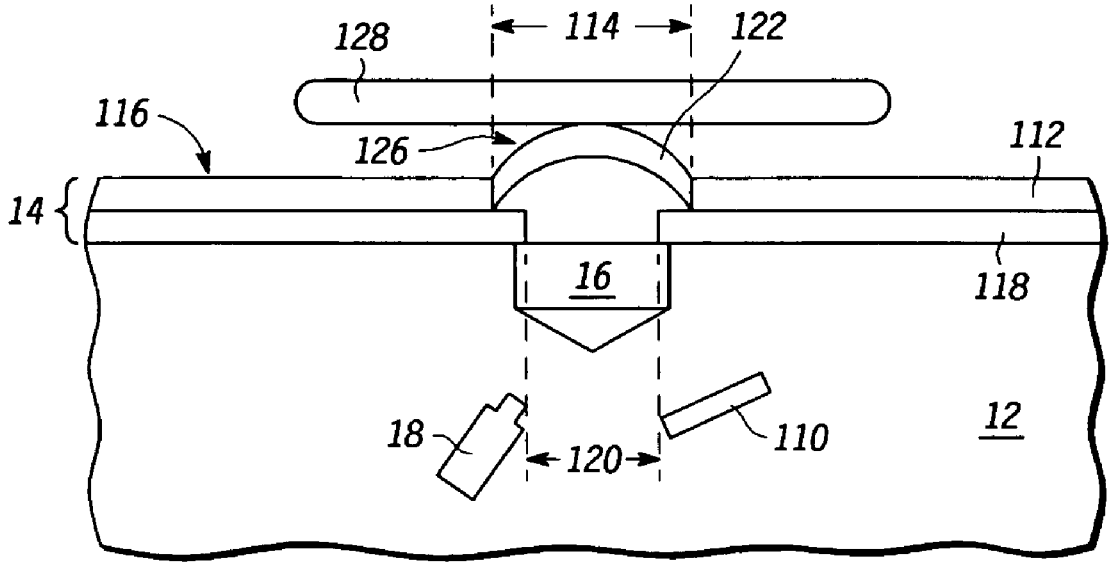
FIG. 1 includes a cross-sectional view of an illustration of a polishing apparatus to perform polishing including a polishing pad and a wafer (prior art).

Skilled artisans appreciate that elements in the figures are illustrated for simplicity and clarity and have not necessarily been drawn to scale. For example, the dimensions of some of the elements in the figures may be exaggerated relative to other elements to help to improve understanding of embodiments of the invention. The use of the same reference symbols in different drawings indicates similar or identical items.

DETAILED DESCRIPTION

A polishing pad can include a first layer including a first polishing surface. The first layer of the polishing pad can also include a first opening extending through the first layer. The polishing pad can further include a second layer adjacent to the first layer. The second layer can include an attaching surface and a second opening extending through the second layer. The second opening can be substantially contiguous with the first opening of the first layer. The polishing pad can also include a pad window lying within the first opening. The pad window can include a second polishing surface substantially contiguous with the first polishing surface of the first layer. The second polishing surface can lie along substantially the same plane as the first polishing surface. The pad window can also include an opposing surface opposite the polishing surface, and be designed to abut an exterior surface of a platen window when the polishing pad would be attached to the platen.

In one aspect, a polishing apparatus can include a platen including a first attaching surface, and a platen window. The platen window can further include an exterior surface substantially parallel to the first attaching surface. The polishing apparatus can also include a polishing pad. The polishing pad can include a first layer spaced apart from the platen, wherein the first layer can include a first polishing surface, a first opposing surface opposite the first polishing surface, and a first opening extending through the first layer. The polishing pad can also include a second layer lying between the first layer and the platen, wherein the second layer can include a second attaching surface immediately adjacent to the first attaching surface of the platen. The second layer of the polishing pad can also include a second opposing surface opposite the second attaching surface, and lying closer to the first opposing surface of the first layer than the first polishing surface of the first layer. The second layer of the polishing pad can further include a second opening extending through the second layer. The polishing pad can also include a pad window lying within the first opening. The pad window can include a second polishing surface substantially co-planar with the first polishing surface, and a third opposing surface immediately adjacent to the exterior surface of the platen window.

In another aspect, a process of performing polishing can include applying a fluid to a polishing surface of a polishing pad that is attached to a platen, the polishing pad comprising a pad window, the pad window comprising a portion of the polishing surface and an opposing surface. The process can also include placing a workpiece adjacent to the polishing pad, and compressing the polishing pad between the workpiece and the platen. The process can further include polishing the workpiece such that the pad window contacts the workpiece and the platen window simultaneously at a substantially same point in time. Specific embodiments of the present disclosure will be better understood with reference to FIGS. 1 through 4.

Some terms are defined or clarified as to their intended meaning as they are used within this specification. As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

The term "composition" is intended to refer to the chemical make up of a substance. A composition can be an element, compound, mixture, solution, alloy, or any combination thereof. For example, the composition of a fabric can be a mixture of wool and cotton fibers.

The term "contiguous" is intended to mean that two or more articles or other objects lie or are otherwise positioned such that nothing of significance lies between the two or more articles or other objects. For example, one of the articles or other objects can touch another one of the articles or other objects.

The term "elevation" is intended to indicate a closest distance between a layer or other object and a reference plane.

As used herein "material" is intended to refer to the physical structure of substance. A material can have a structure with pores or gaps in it. For example, a fabric is a material made from fibers and has pores (e.g. gaps between the fibers). These pores are considered distinct from a hole, which is an interruption of the structure. A buttonhole is an example of a hole in a fabric.

The term "workpiece" is intended to mean a substrate and, if any, one or more layers one or more structures, or any combination thereof attached to the substrate, at any particular point of a process sequence. Note that the substrate may not significantly change during a process sequence, whereas the workpiece significantly changes during the process sequence. For example, at the beginning of a process sequence, the substrate and workpiece are the same. After a layer is formed over the substrate, the substrate has not changed, but now the workpiece includes the combination of the substrate and the layer.

Additionally, for clarity purposes and to give a general sense of the scope of the embodiments described herein, the use of the "a" or "an" are employed to describe one or more articles to which "a" or "an" refers. Therefore, the description should be read to include one or at least one whenever "a" or "an" is used, and the singular also includes the plural unless it is clear that the contrary is meant otherwise.

Unless otherwise defined, all technical and scientific terms used herein have the same meaning as commonly understood by one of ordinary skill in the art to which this invention belongs. All publications, patent applications, patents, and other references mentioned herein are incorporated by reference in their entirety. In case of conflict, the present specification, including definitions, will control. In addition, the materials, methods, and examples are illustrative only and not intended to be limiting.

Figure 2:
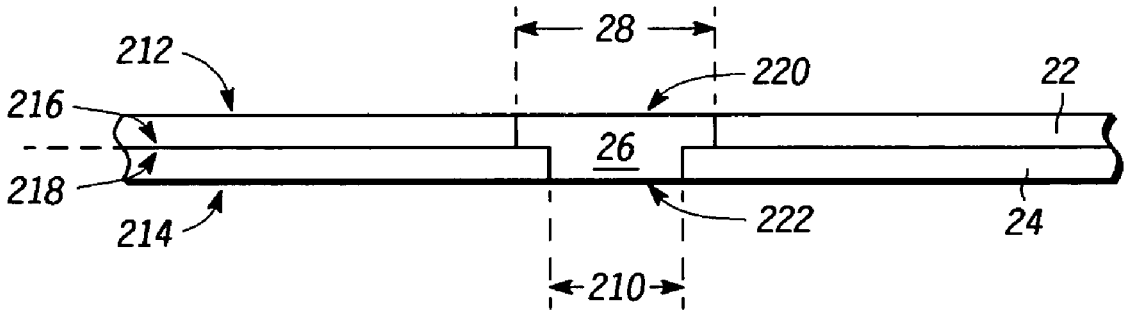
FIG. 2 includes an illustration of a cross-sectional view of an embodiment of a polishing pad.

FIG. 2 includes an illustration of a cross-sectional view of a polishing pad 20 including a layer 22, a layer 24, and a pad window 26. The layer 22 can include a polishing surface 212 that is designed to be substantially planar when the polishing pad 20 would be attached to a platen. The layer 22 can also have an opposing surface 216 opposite the polishing surface 212. The layer 22 can include a material that is solid, open cell, closed cell, woven, felted, or any combination thereof. The layer 22 can have a composition that includes a rubber compound, a urethane compound, an adhesive compound, or any combination thereof. The layer 22 can include an opening 28. The layer 22 can have a thickness in a range of approximately 0.05 mm to approximately 12.7 mm (approximately 2 to approximately 500 mils). In one embodiment, the opening 28 can extend through an entire thickness of the layer 22.

The layer 24 can include an attaching surface 214 that is designed to attach to a corresponding attaching surface of a platen. The layer 24 can also have an opposing surface 218 opposite the attaching surface 214. The layer 24 can have a thickness in a range of approximately 0.05 mm to approximately 12.7 mm (approximately 2 to approximately 500 mils). In one embodiment, the opposing surface 218 can be adjacent to the opposing surface 216 of the layer 22. In another embodiment, the layer 22 can lie immediately adjacent to the layer 24. The layer 24 can include a material or composition as described for the layer 22. The layer 24 can have a same or a different material or composition as the layer 22. The layer 24 can include an opening 210. In one embodiment, the opening 210 can extend through an entire thickness of the layer 24 and be contiguous with the opening 28. The opening 28 can have a perimeter of a same or a different length than a perimeter of the opening 210. The opening 28 can lie adjacent to the opening 210 such that each of the opening 28 and the opening 210 can comprise a portion of a contiguous region.

The pad window 26 can lie within the opening 28, and include a polishing surface 220 and an opposing surface 222. The polishing surface 220 can have a texture. For example, in one embodiment, the polishing surface 220 can be grooved or perforated. The polishing surface 220 can be substantially contiguous with the polishing surface 212. The polishing surface 220 can lie along a substantially same plane as the polishing surface 212, and the opposing surface 222 can be designed to abut an exterior surface of a platen window when the polishing pad would be attached to a platen. In an embodiment, the pad window 26 can have a composition capable of allowing transmission of a predetermined wavelength or spectrum of radiation. In one embodiment, the pad window 26 can include a urethane material, a rubber based material, a polyethylene, a polytetrafluoroethylene ("PTFE"), a polypropylene, or any combination thereof. In a particular embodiment, the pad window 26 can lie immediately adjacent to the layer 22 along the perimeter of the opening 28. In a more particular embodiment, the pad window 26 can lie immediately adjacent to the layer 24 along the perimeter of the opening 210.

The layer 22 and the layer 24 of the polishing pad 20 can be formed separately and subsequently can be attached together by a conventional or proprietary technique. In one embodiment, the opening 28 in the layer 22 and the opening 210 in the layer 24 can be formed prior to attaching the layer 22 and the layer 24 together. In another embodiment the layer 22 and the layer 24 can be joined together before the opening 28 and the opening 210 are formed. The pad window 26 can be bonded, glued, set, molded in place or otherwise attached using a conventional or proprietary technique within a region including both of the opening 28 and the opening 210. In one embodiment, the pad window can substantially fill the portion of the region including both the opening 28 and the opening 210 between the polishing surface 220 and the location where an exterior surface of a platen window would be when the pad is attached to a platen.

Figure 3:
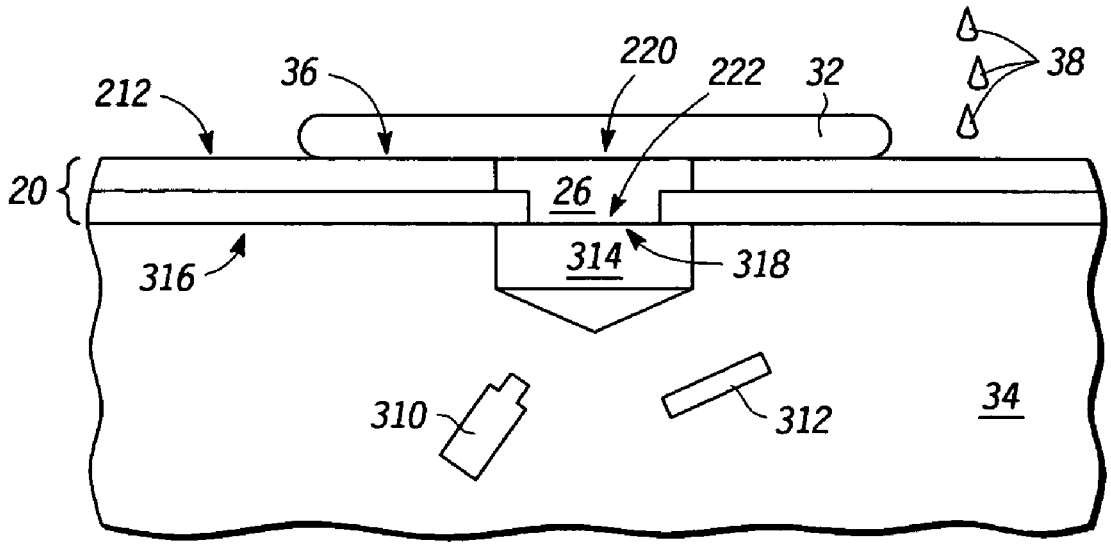
FIG. 3 includes an illustration of a cross-sectional view of a workpiece and a portion of a polishing apparatus including a polishing pad, during polishing, in accordance with an embodiment.
Figure 4:
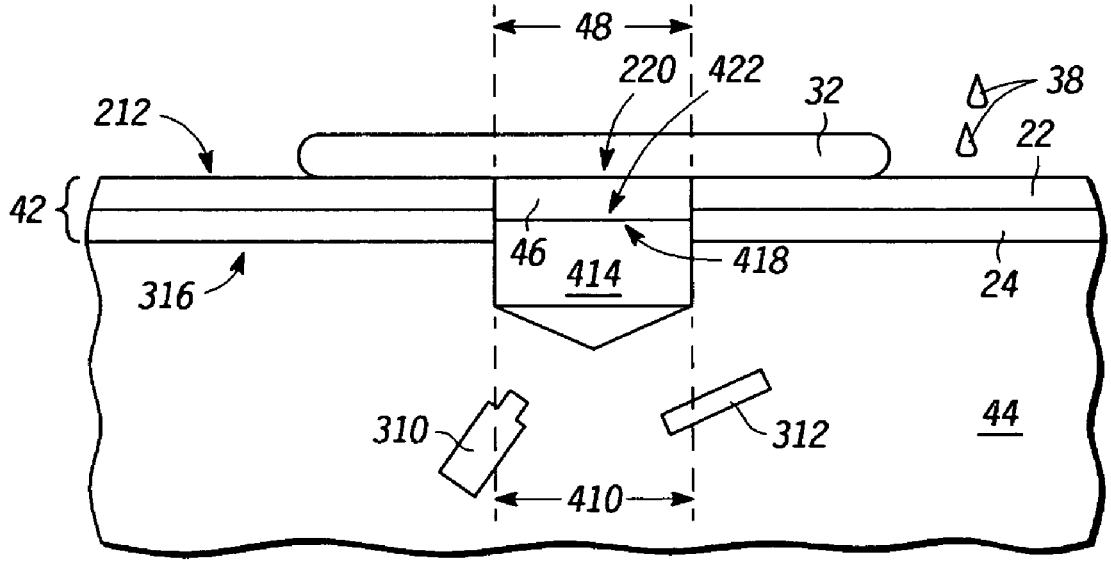
FIG. 4 includes an illustration of a cross-sectional view of a workpiece and a portion of a polishing apparatus including a polishing pad, during polishing, in accordance with an alternative embodiment.

FIG. 3 includes an illustration of a cross-sectional view of a workpiece 32 and a polishing apparatus 30, including the polishing pad 20. The polishing pad 20 can lie between the workpiece 32 and a platen 34. The workpiece 32 can include a substrate comprising a plurality of layers. The workpiece 32 can have a work surface 36 from which material is to be removed. A fluid 38 can be applied to the polishing surface 212 and the polishing surface 220 of the polishing pad 20. The fluid 38 can be a solution, a colloidal suspension, a slurry, water, or any combination thereof and can include an acid, a base, a buffer, an abrasive, or any combination thereof.

The platen 34 may be mechanically driven, and include a platen window 314 and an attaching surface 316. In one embodiment, the attaching surface 316 of the platen 34 can lie adjacent to the attaching surface 214 of the polishing pad 20. The attaching surface 316 of the platen 34 can be designed to be rigid or flexible. The platen 34 can include a material that includes a ceramic, metal, stone, rubber, plastic, PTFE, epoxy, or any combination thereof. In one embodiment, the attaching surface 316 of the platen 34 can be substantially planar such that the polishing surface 212 of the polishing pad 20 attached to the platen 34 can also be substantially planar. In another embodiment, the platen window 314 can have an exterior surface 318 that is substantially planar and substantially parallel to the attaching surface 316. In still another embodiment, the platen window 314 can have a composition that can allow a predetermined wavelength or spectrum of radiation can be transmitted through the platen window 314.

The polishing pad 20 can be attached to the platen 34 such that the opposing surface 222 of the pad window 26 can abut the exterior surface 318 of the platen window 314. In one embodiment, the platen window 314 can lie adjacent to the opening 210 of the layer 24 of the polishing pad 20 such that a radiation beam of the predetermined wavelength or spectrum can be directed through the opposing surface 222 and the polishing surface 220 of the pad window 26. In a particular embodiment, the exterior surface 318 of the platen window 314 and the opposing surface 222 of the pad window 26 can be attached to each other.

The workpiece 32 can be placed adjacent to the polishing pad 20. The polishing pad 20 can be compressed between the workpiece 32 and the platen 34 by applying a pressure to the workpiece 32, to the platen 34, or any combination thereof. The polishing pad 20, including the polishing surface 212 and the polishing surface 220 can be moved relative to the work surface 36 of the workpiece 32, the work surface 36 can be moved relative to the polishing pad 20, or any combination thereof. The pad window 26 can lay between the workpiece 32 and the platen window 314. In such an arrangement, the polishing surface 220 of the pad window 26 can contact the workpiece 32 simultaneously at a substantially same point in time as the opposing surface 222 of the pad window 26 can contact the exterior surface 318 of the platen window 314.

In one embodiment, a radiation source 310 can be directed such that a radiation beam can pass through the opposing surface 222 and the polishing surface 220 of the pad window 26 of the polishing pad 20. The radiation beam can include visible light, coherent light, infrared light, ultraviolet light, x-rays, radio waves, sonic vibration, subsonic vibration, hypersonic vibration, or any combination thereof. The radiation beam can contact the workpiece 32 and subsequently be detected by a detector 312. In the illustrated embodiment, the radiation beam can be reflected from the workpiece 32 such that the radiation beam can pass through the opposing surface 222 of the pad window a second time prior to reaching the detector 312. In another embodiment, the detector 312 can be positioned differently. For example, the detector 312 can be in line with the original beam line such that the radiation beam can pass through the workpiece 32 prior to detection. In a particular embodiment, the detected wavelength or spectrum can be analyzed and used as an endpoint criterion for the process. In a more particular embodiment, another criterion, such as time, another output signal from the polishing apparatus 30 (e.g., another sensor on the polishing apparatus 30), a signal from an associated piece of equipment (e.g., a chemical delivery system or a metrology tool), or any combination thereof can also be used in addition to the analysis of the detected wavelength or spectrum as an end point criterion for the process.

In a particular embodiment, the fluid 38 can be substantially opaque to a radiation beam of the predetermined wavelength or spectrum from the radiation source 310, such that an approximately 1 mm thick layer can reduce the intensity of the radiation beam below the detection limit of the detector 312. In a particular embodiment, pooling of the fluid 38 between the polishing surface 220 and the workpiece 32 can substantially block radiation from the radiation source 310 from reaching the workpiece 32.

In another embodiment, an exterior surface of a platen window that may lie along a different plane. In accordance with this embodiment, FIG. 4 includes an illustration of a cross-sectional view of the workpiece 32 and a polishing apparatus 40, including a polishing pad 42. The polishing pad 42 can lie between the workpiece 32 and a platen 44. The polishing pad 42 can have the layer 22 and the layer 24 as previously described for the polishing pad 20. The layer 22 can have an opening 48 and the layer 24 can have an opening 410. The opening 48 and the opening 410 can be substantially contiguous with each other. The polishing surface 212 and the polishing surface 220 can be contiguous and lie along a substantially same plane. An opposing surface 422 of a pad window 46 can abut an exterior surface 418 of a platen window 414.

In a particular embodiment, the exterior surface 418 can lie along a plane closer to the plane along the polishing surface 220 than a plane along the attaching surface 316. In the illustrated embodiment, the exterior surface 418 can lie along a plane closer to the plane along the attaching surface 316 than the plane along the polishing surface 220. In another embodiment, the plane along the attaching surface 316 can lie between the plane along the exterior surface 418 and the plane along the polishing surface 220. Similarly, in one embodiment, the opposing surface 422 of the pad window 46 can lie closer to the polishing surface 220 than the attaching surface 214. In another embodiment, the opposing surface 422 can lie closer to the attaching surface 214 than the polishing surface 220.

Thus, a polishing pad can include a pad window with an opposing surface that abuts a platen window when the pad would be attached to a platen. The polishing pad can have less distortion of the pad window than a conventional polishing pad with a conventional window. Problems with endpoint detection, the pad window becoming separated from the remainder of the polishing pad, excessive wear of the pad window, a breach of the pad window, damage to the polishing apparatus, damage to the substrate, or any combination thereof may be substantially reduced or eliminated. Thus, a polishing apparatus and an associated process of polishing can have fewer problems.

Many different aspects and embodiments are possible. Some of those aspects and embodiments are described below. After reading this specification, skilled artisans will appreciate that those aspects and embodiments are only illustrative and do not limit the scope of the present invention.

To the extent not described herein, many details regarding specific materials, processing acts, and circuits are conventional and may be found in textbooks and other sources within the semiconductor and microelectronic arts. Other features and advantages of the invention will be apparent from the following detailed description, and from the claims.

In a first aspect, a polishing pad can include a first layer. The first layer can include a first polishing surface and a first opening extending through the first layer. The polishing pad can also include a second layer adjacent to the first layer. The second layer can include an attaching surface and a second opening extending through the second layer. The second opening can be substantially contiguous with the first opening of the first layer. The polishing pad can further include a pad window lying within the first opening. The pad window can include a second polishing surface substantially contiguous with the first polishing surface of the first layer, and lying in substantially a same plane as the first polishing surface. The pad window can also include an opposing surface opposite the second polishing surface, and designed to abut an exterior surface of a platen window when the polishing pad would be attached to the platen.

In one embodiment of the first aspect, the pad window has a composition that is capable of allowing transmission of a predetermined wavelength or spectrum of radiation. In another embodiment, a first perimeter of the first opening has a different length than a second perimeter of the second opening. In still another embodiment, the first opening has a first perimeter, the second opening has a second perimeter, and the pad window lies immediately adjacent to the second layer along the second perimeter.

In another embodiment of the first aspect, the first polishing surface of the first layer lies in a first plane, and the attaching surface of the second layer lies in a second plane. The opposing surface of the pad window lies in a third plane, the third plane lying closer to the first plane than the second plane. In yet another embodiment, the opposing surface of the pad window lies closer to the attaching surface of the second layer than the first polishing surface of the first layer. In still another embodiment, the first layer lies immediately adjacent to the second layer. In a further embodiment, each of the first layer and the pad window includes a urethane material, a rubber based material, a polyethylene, a polytetrafluoroethylene ("PTFE"), a polypropylene, or any combination thereof.

In a second aspect, a polishing apparatus can include a platen. The platen can include a first attaching surface, and a platen window including an exterior surface substantially parallel to the first attaching surface. The polishing apparatus can also include a polishing pad. The polishing pad can include first layer spaced apart from the platen. The first layer can include a first polishing surface and a first opposing surface opposite the first polishing surface. The first layer can also include a first opening extending through the first layer. The polishing pad can also include a second layer lying between the first layer and the platen. The second layer can include a second attaching surface immediately adjacent to the first attaching surface of the platen. The second layer can also include a second opposing surface opposite the second attaching surface, and lying closer to the first opposing surface of the first layer than the first polishing surface of the first layer. The second layer can further include a second opening extending through the second layer. The polishing pad can further include a pad window lying within the first opening. The pad window can include a second polishing surface substantially co-planar with the first polishing surface. The pad window can also include a third opposing surface immediately adjacent to the exterior surface of the platen window.

In a particular embodiment of the second aspect, the pad window includes a composition that is capable of allowing transmission of a predetermined wavelength or spectrum of radiation. In a more particular embodiment, the polishing apparatus can further include a radiation source designed to direct the predetermined wavelength or spectrum of radiation through the second polishing surface of the pad window.

In another particular embodiment of the second aspect, the exterior surface of the platen window lies in a different plane than the first attaching surface. In a more particular embodiment, the exterior surface of the platen window lies closer in elevation to the second polishing surface of the pad window than the first attaching surface of the platen. In another more particular embodiment, the exterior surface of the platen window lies closer in elevation to the first attaching surface of the platen than the second polishing surface of the pad window. In another embodiment, the exterior surface of the platen window and the third opposing surface of the pad window are attached to each other.

In a third aspect, a process of performing polishing can include applying a fluid to a polishing surface of a polishing pad. The polishing pad can be attached to a platen. The polishing pad can include a pad window. The pad window can include a portion of the polishing surface and an opposing surface. The process can also include placing a workpiece adjacent to the polishing pad. The process can further include compressing the polishing pad between the workpiece and the platen. The process can still further include polishing the workpiece such that the pad window contacts the workpiece and a platen window of the platen simultaneously at a substantially same point in time.

In one embodiment of the third aspect, the process can further include directing a radiation beam through the polishing surface, and detecting a predetermined wavelength or spectrum of radiation from the radiation beam. In more particular embodiment, the process can further include analyzing the radiation beam after detecting the predetermined wavelength or spectrum of radiation, and determining whether an endpoint has been reached. In still another embodiment, the fluid is substantially opaque to the predetermined wavelength or spectrum of radiation. In yet another embodiment, directing the radiation beam further includes directing the radiation beam such that the radiation beam passes through the opposing surface of the pad window more than one time prior to detecting the predetermined wavelength or spectrum of radiation.

Note that not all of the activities described above in the general description or the examples are required, that a portion of a specific activity may not be required, and that one or more further activities may be performed in addition to those described. Still further, the order in which activities are listed are not necessarily the order in which they are performed. After reading this specification, skilled artisans will be capable of determining which one or more activities or one or more portions thereof are used or not used and the order of such activities are to be performed for their specific needs or desires.

Any one or more benefits, one or more other advantages, one or more solutions to one or more problems, or any combination thereof have been described above with regard to one or more specific embodiments. However, the benefit(s), advantage(s), solution(s) to problem(s), or any element(s) that may cause any benefit, advantage, or solution to occur or become more pronounced is not to be construed as a critical, required, or essential feature or element of any or all the claims.

The above-disclosed subject matter is to be considered illustrative, and not restrictive, and the appended claims are intended to cover all such modifications, enhancements, and other embodiments that fall within the scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. A process of polishing comprising:

providing a polishing pad comprising:

a first layer comprising:

a first polishing surface; and a first opening extending through the first layer;

a second layer distinct from and adjacent to the first layer, wherein the second layer comprises:

a pad attaching surface; and a second opening extending through the second layer, the second opening substantially contiguous with the first opening of the first layer;

wherein a first perimeter of the first opening has a different cross-section size than a second perimeter of the second opening; and a pad window lying within the first opening, the pad window comprising:

a second polishing surface substantially contiguous with the first polishing surface of the first layer, and lying in substantially a same plane as the first polishing surface; and an opposing surface opposite the second polishing surface, and designed to abut an exterior surface of a platen window; attaching the pad to a platen so that the pad window and platen window abut;

applying a fluid to the first polishing surface, wherein the polishing pad is attached to a platen;

placing a workpiece adjacent to the polishing pad;

compressing the polishing pad between the workpiece and the platen; and polishing the workpiece such that the pad window contacts the workpiece.

2. The process of claim 1, wherein the pad window has a composition that is capable of allowing transmission of a predetermined wavelength or spectrum of radiation.

3. The process of claim 1, wherein a first perimeter of the first opening has a different size than a second perimeter of the second opening.

4. The process of claim 1, wherein the first opening has a first perimeter, the second opening has a second perimeter, and the pad window lies immediately adjacent to the second layer along the second perimeter.

5. The process of claim 1, wherein:

the polishing surface of the first layer lies in a first plane;

the pad attaching surface of the second layer lies in a second plane; and the opposing surface of the pad window lies in a third plane, the third plane lying closer to the first plane than the second plane.

6. The process of claim 1, wherein the opposing surface of the pad window lies closer to the pad attaching surface of the second layer than the polishing surface of the first layer.

7. The process of claim 1, wherein the first layer lies immediately adjacent to the second layer, and a combination of the first layer and the second layer define an interface.

8. The process of claim 1, wherein the second layer includes a different material as compared to the first layer.

9. The method of claim 1, wherein the platen comprises:

a platen attaching surface; and a platen window comprising an exterior surface substantially parallel to the platen attaching surface; and the first layer is spaced apart from the platen, wherein the first layer comprises a first opposing surface opposite the polishing surface;

the second layer lies between the first layer and the platen, wherein:

the pad attaching surface lies immediately adjacent to the platen attaching surface; and the second layer further comprises a second opposing surface opposite the pad attaching surface, wherein the second opposing surface lies closer to the first opposing surface of the first layer than the polishing surface of the first layer.

10. The process of claim 9, wherein the pad window comprises a composition that is capable of allowing transmission of a predetermined wavelength or spectrum of radiation.

11. The process of claim 10, further comprising a radiation source designed to direct the predetermined wavelength or spectrum of radiation through the pad window polishing surface of the pad window.

12. The process of claim 9, wherein the exterior surface of the platen window lies in a different plane than the pad attaching surface.

13. The process of claim 12, wherein the exterior surface of the platen window lies closer in elevation to the second polishing surface of the pad window than the platen attaching surface.

14. The process of claim 12, wherein the exterior surface of the platen window lies closer in elevation to the platen attaching surface than the second polishing surface of the pad window.

15. The process of claim 9, wherein the exterior surface of the platen window and the opposing surface of the pad window are attached to each other.

16. The process of claim 1, wherein polishing the workpiece comprises polishing the workpiece such that the pad window and the platen window of the platen contact simultaneously at a substantially same point in time.

17. The process of claim 1, further comprising:

directing a radiation beam through the second polishing surface; and detecting a predetermined wavelength or spectrum of radiation from the radiation beam.

18. The process of claim 17, further comprising:

analyzing the radiation beam after detecting the predetermined wavelength or spectrum of radiation; and determining whether an endpoint has been reached.

19. The process of claim 17, wherein the fluid is substantially opaque to the predetermined wavelength or spectrum of radiation.

20. The process of claim 17, wherein directing the radiation beam further comprises directing the radiation beam such that the radiation beam passes through the opposing surface of the pad window more than one time prior to detecting the predetermined wavelength or spectrum of radiation.

* * * * *